United States Patent [19]

Molitor et al.

[11] Patent Number: 4,515,581

[45] Date of Patent: May 7, 1985

[54] MACHINE FOR ERECTING, HOLDING AND DISCHARGING A FOLDING CASE

[75] Inventors: Edwin A. Molitor, Miami Township, Clermont County; Edward Crain, Blue Ash; Guy W. Lampe, Anderson Township, Hamilton County, all of Ohio

[73] Assignee: Multifold-International, Inc., Milford, Ohio

[21] Appl. No.: 536,766

[22] Filed: Sep. 28, 1983

[51] Int. Cl.[3] ..... B31B 5/60

[52] U.S. Cl. ..... 493/183; 493/309; 493/453; 53/374; 53/564; 53/381 R

[58] Field of Search ..... 493/162, 183, 309, 318, 493/453; 53/374, 381 R, 491, 564

[56] References Cited

U.S. PATENT DOCUMENTS

| | | | |
|---|---|---|---|
| 2,739,513 | 3/1956 | Dobson | 493/453 |
| 3,358,567 | 12/1967 | Tucker et al. | 53/564 |
| 4,063,492 | 12/1977 | Lesek | 493/18 |

*Primary Examiner*—Francis S. Husar
*Assistant Examiner*—Jorji M. Griffin
*Attorney, Agent, or Firm*—James W. Pearce; Roy F. Schaeperklaus

[57] ABSTRACT

A device for erecting a folding carton and for holding the folding carton. The device includes a table formed of an elongated input segment and an elongated output segment. The segments are hinged together tandemwise. An anchor support member supports an input end of the input segment. An output support underlies an output end portion of the output segment. The anchor support member moves between a lowered position in which the segments of the table form a V-shape and a raised position in which the segments of the table are substantially horizontally aligned. Lower end flap of the carton engage the segments when in lowered position to partially fold the lower end flaps. The lower end flaps are further folded when the segments are advanced from the lowered position to the raised position. Side flap folding members are hingedly mounted on opposite sides of the table. The side flap folding members swing between a lowered position free of the table segments and a raised position underlying and supporting the lower side flaps in closed position. A pusher member slides the carton with folded lower flaps off the output end of the output segment to remove the carton from the table segments.

5 Claims, 21 Drawing Figures

FIG. 13
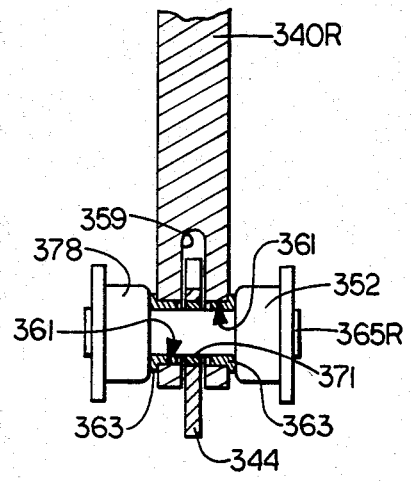
FIG. 14
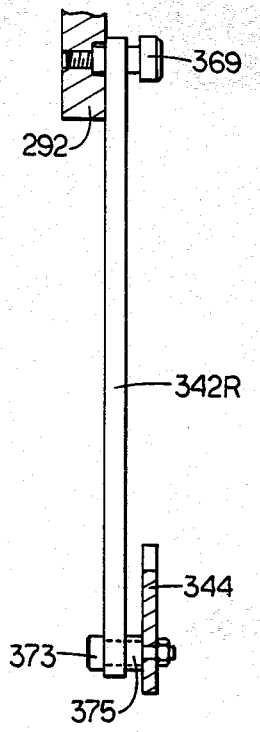
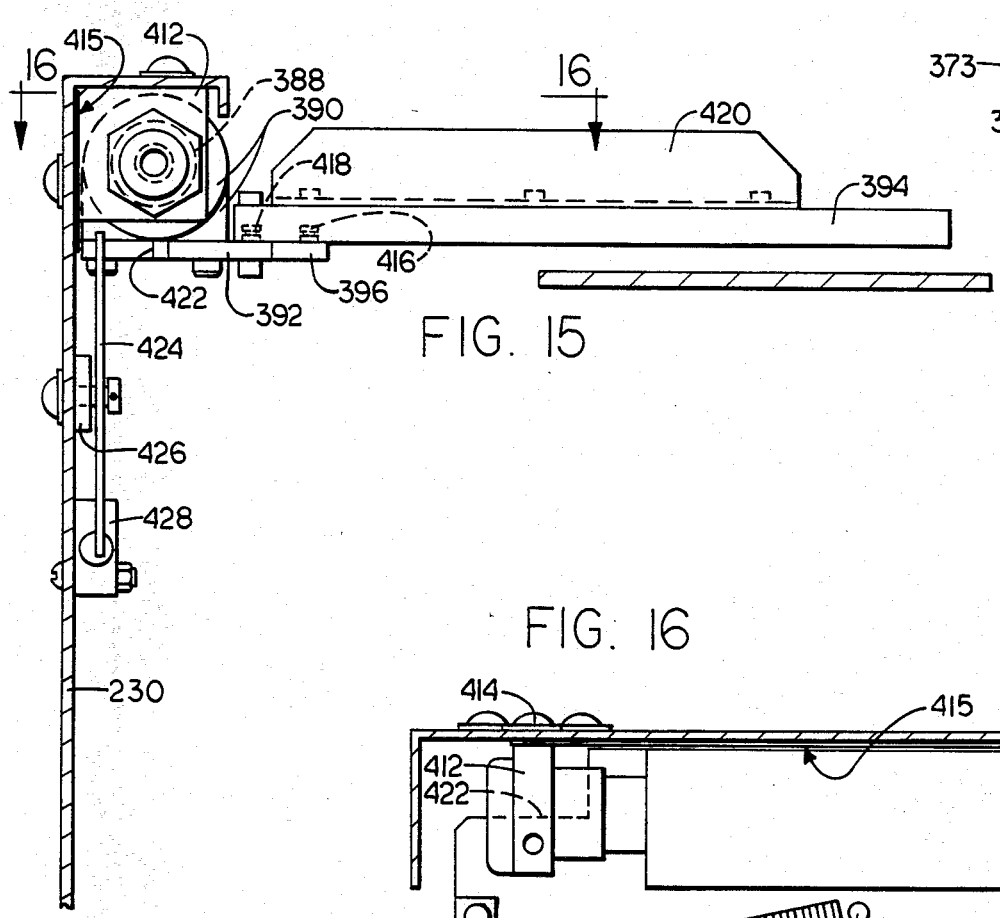
FIG. 15
FIG. 16
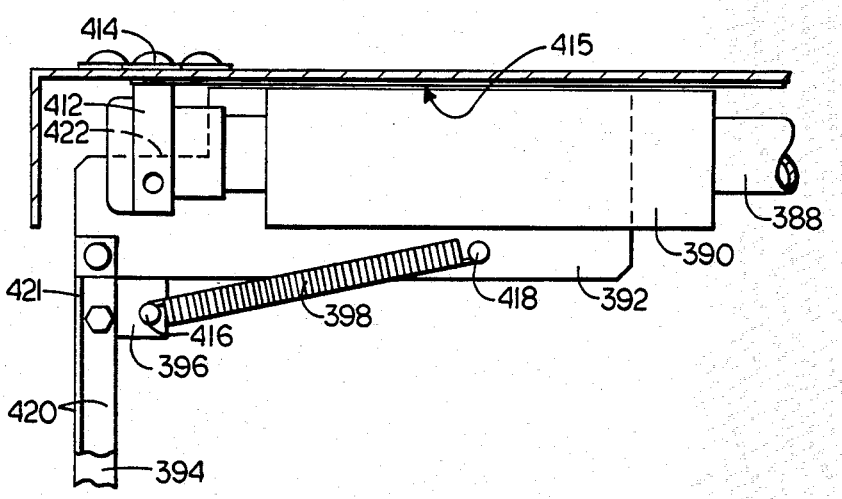

MACHINE FOR ERECTING, HOLDING AND DISCHARGING A FOLDING CASE

BACKGROUND OF THE INVENTION

This invention relates to a machine for erecting a folding carton. The machine of this invention represents an improvement in the type of machine shown in Lesak U.S. Pat. No. 4,063,492.

SUMMARY OF THE INVENTION

Briefly, this invention provides a machine which receives a folding case or carton and erects the carton as the carton is inserted into the machine. The carton can be loaded and the machine discharges the loaded carton. The machine includes a table made up of two elongated sections hinged together at ends thereof. The table moves between a lowered position in which the elongated sections meet in a V-shaped angle and a raised position in which the sections are in substantially horizontal alignment. When the table is in lowered position, a carton can be mounted on the table with lower minor or end flaps engaging the elongated sections. The table is lifted to raised position to fold the minor flaps into horizontal alignment. Roller frames are mounted on opposite sides of the elongated table sections and swing between a lowered upright position free of the table sections and a raised horizontal position underlying the raised table sections. As the roller frames swing upwardly, they urge major or side flaps of the carton to closed position underlying the table sections. While the carton rests on the table sections and the roller frames, the carton can be loaded. A pusher member advances the loaded carton from the table lengthwise of the table sections. An outlet end of and output table section can rest freely on a support, and the carton can be slid off the machine to be discharged. The remote end of the other table section can be mounted on apparatus which swings the table sections between lowered and raised positions. The above and other objects and features of the invention will be apparent to those skilled in the art to which this invention pertains from the following detailed description and the drawings.

BRIEF DESCRIPTION OF THE DRAWINGS

FIG. 13 is a view in section taken on the line 13—13 in FIG. 12;

FIG. 14 is a view in section taken on the line 14—14 in FIG. 12;

FIG. 15 is a fragmentary view in transverse section of the machine;

FIG. 16 is a fragmentary view in horizontal section taken generally on the line 16—16 in FIG. 15;

DESCRIPTION OF THE PREFERRED EMBODIMENT

Figure 1:
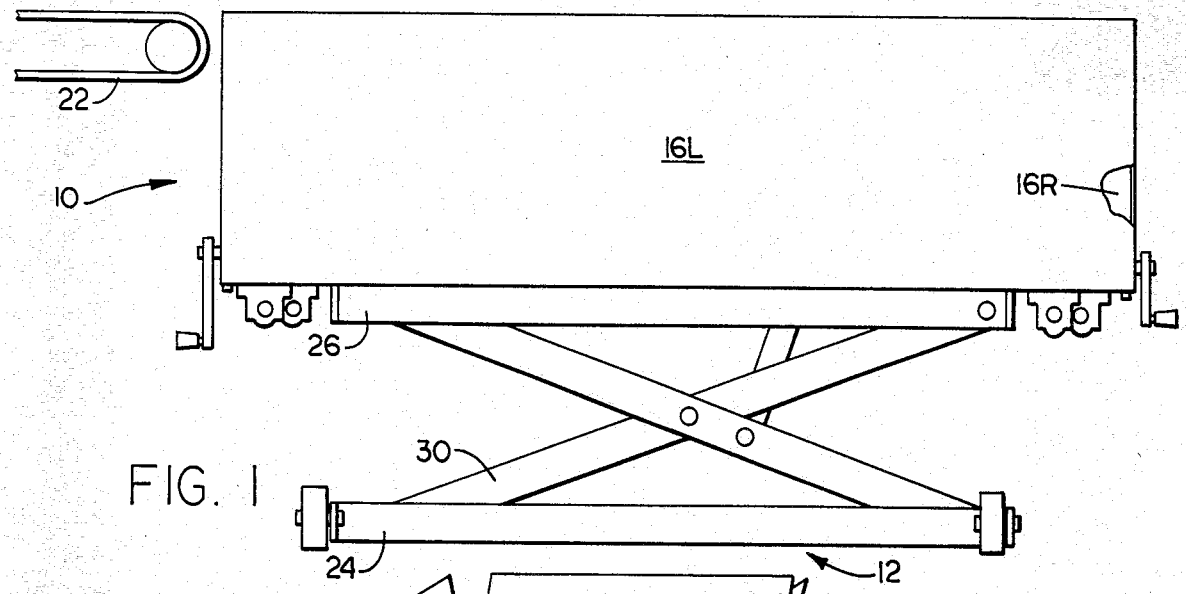
FIG. 1 is a somewhat schematic view in side elevation of a machine constructed in accordance with an embodiment of this invention.

In the following detailed description and the drawings, like reference characters indicate like parts.

FIG. 1 shows a case erector 10, which is constructed in accordance with a preferred embodiment of this invention. The machine is a semi-automatic case erector.

Hereinafter the input end of the case erector 10 will be that end to the right side of FIG. 1 and the output end will be that end to the left side of the figure. FIG. 1 is a view in elevation of the left side of the machine. The word longitudinal will refer to the length of the machine; that is, from end to end, and the transverse direction will refer to the width of the machine.

Figure 1A:
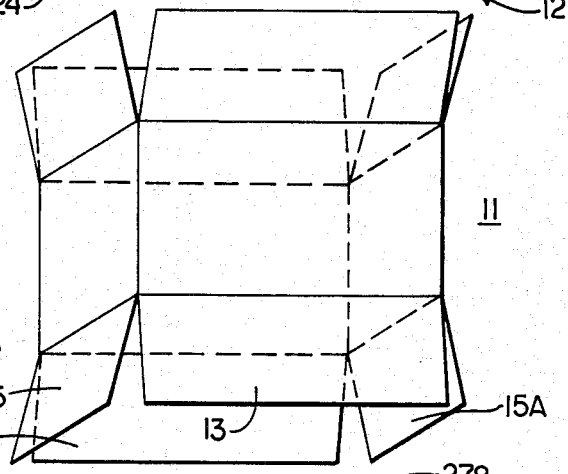
FIG. 1A is a perspective view of a carton which is erected by the machine.

An operator stands in front of the machine as viewed in FIG. 1, opens and squares a corrugated case 11 and inserts the case 11 downwardly into the top of the machine. Elements in the machine close and hold major bottom flaps 13 and 13A (FIG. 1A) and minor bottom flaps 15 and 15A in such a way that the case 11 can be loaded with a slug of cartons or the like (not shown) and easily transported to an output conveyor 22 (FIG. 1) for tape sealing or the like.

Figure 2:
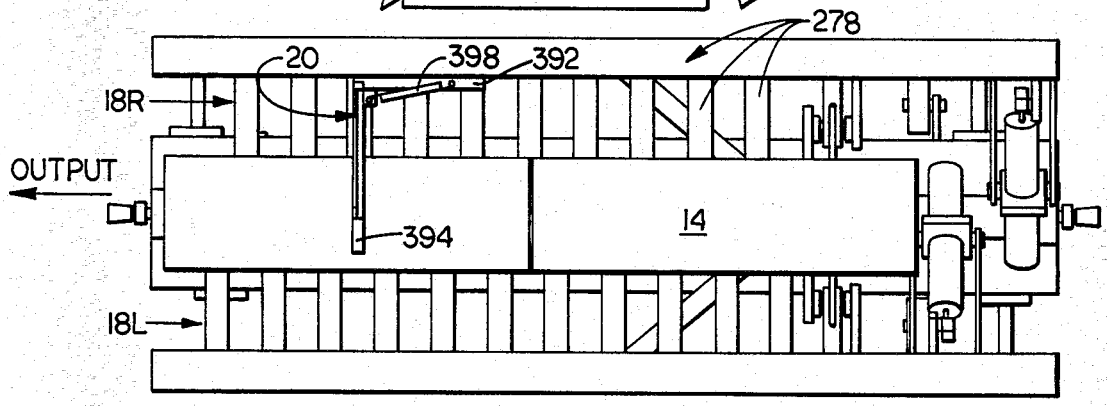
FIG. 2 is a top plan view of the machine illustrated in FIG. 1.

The case erector 10 (FIGS. 1 and 2) is comprised of an adjustable base 12, a table assembly 14, sides 16R and 16L, roller assemblies 18R and 18L, and a case ejector 20.

The adjustable base 12 is comprised of a floor frame 24, a base frame 26, a base plate 28 (FIG. 3), and a scissors assembly 30. Referring to FIGS. 3, 4, 5 and 6, the floor frame 24 is further comprised of right and left channel members 33R and 33L, an input plate 35, and an output plate 37. The output surface of the input plate 35 is rigidly affixed across the input extremities of the longitudinally disposed channel members 33R and 33L. The ends of the input plate 35 extend outboardly from the channel members 33R and 33L to provide mounting for wheels 39. The wheels 39 are rotatably mounted upon shoulder bolts 41 that are in turn fixedly attached through the outer ends of the input plate 35, and extend in the output direction therefrom. The input surface of the output plate 37 is rigidly affixed to the output extremities of the channel members 33 and similarly provides mounting for an output wheel 43. The output wheel 43 is rotatably mounted on a shoulder bolt 45 that is in turn fixedly attached at a mostly central location through the output surface of the output plate 37. The base frame 26 is comprised of upper channel members 47R and 47L, an upper input plate 49, and an upper output plate 51. Flanges of the upper channel members 47R and 47L face each other and are rigidly affixed in spaced parallel relationship by the input and output plates 49 and 51, respectively. The width of the rectangular base frame 26 coincides with the width of the base plate 28. The base plate 28 is fixedly attached to the base frame 26 by a set of bolts 53.

Figure 6:
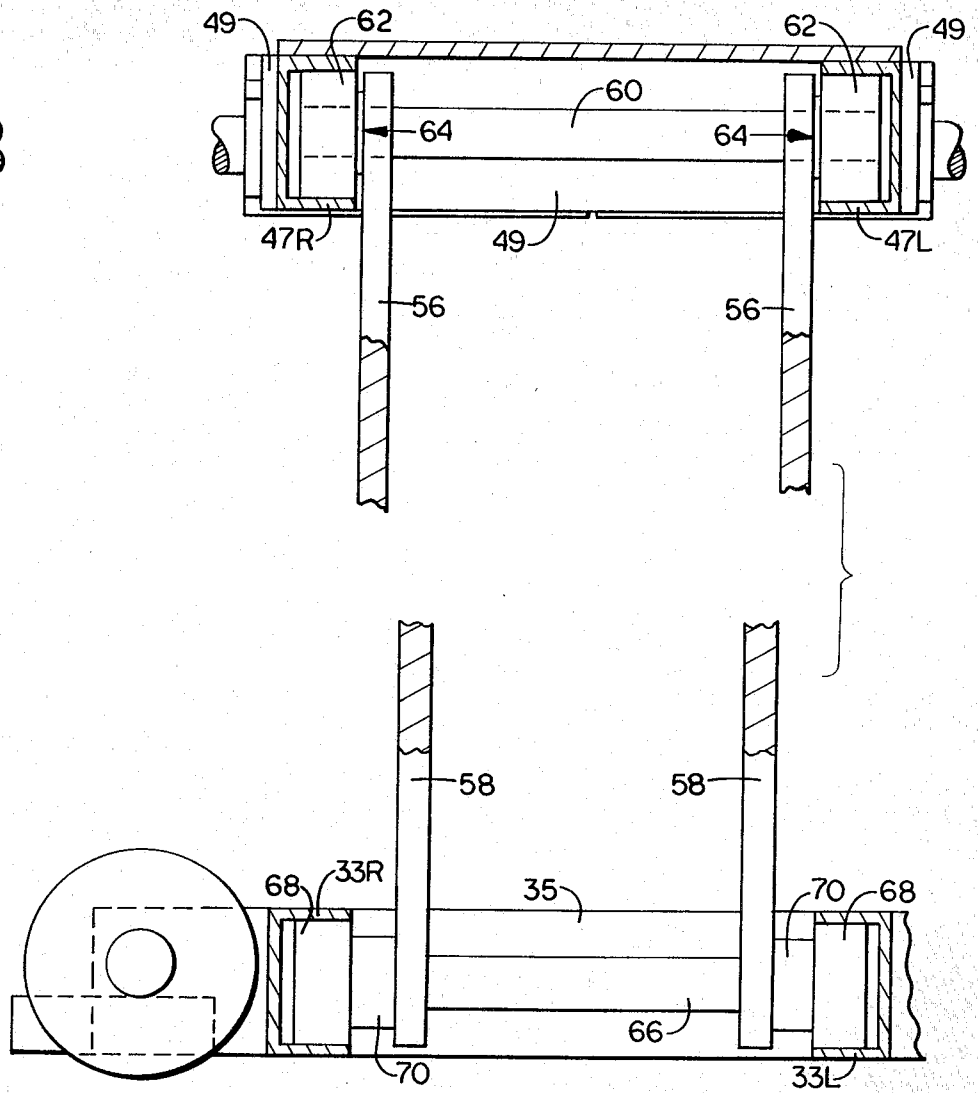
FIG. 6 is a view in section taken on the line 6—6 in FIG. 3.

The base frame 26 and the base plate 28 are adjustably mounted above the floor frame 24 by the scissors assembly 30. The scissors assembly 30 incorporates a pair of outer diagonal bars 56 and a pair of inner diagonal bars 58. As is shown in FIG. 6, the input ends of the outer diagonal bars 56 are pivotally mounted upon an upper input bar 60 that is in turn fixedly attached at its ends in upper pivot blocks 62. The upper pivot blocks 62 are rigidly affixed to the output surface of the upper input plate 49 and to the inner confines of the upper channel members 47R and 47L. Thrust bearings 64 are interposed between the upper outboard surfaces of the outer diagonal bars 56 and the inboard surfaces of the upper pivot blocks 62.

The input ends of the pair of inner diagonal bars 58 are pivotally mounted upon a lower input bar 66 that is in turn fixedly attached at its ends in lower pivot blocks 68. The lower pivot blocks 68 are rigidly affixed to the output surface of the input plate 35 of the floor frame 24 and to the inner confines of the channel members 33R and 33L. Lateral separation is maintained between the lower input blocks 68 and the lower ends of the inner diagonal bars 58 by cylindrical spacers 70.

Figure 3:
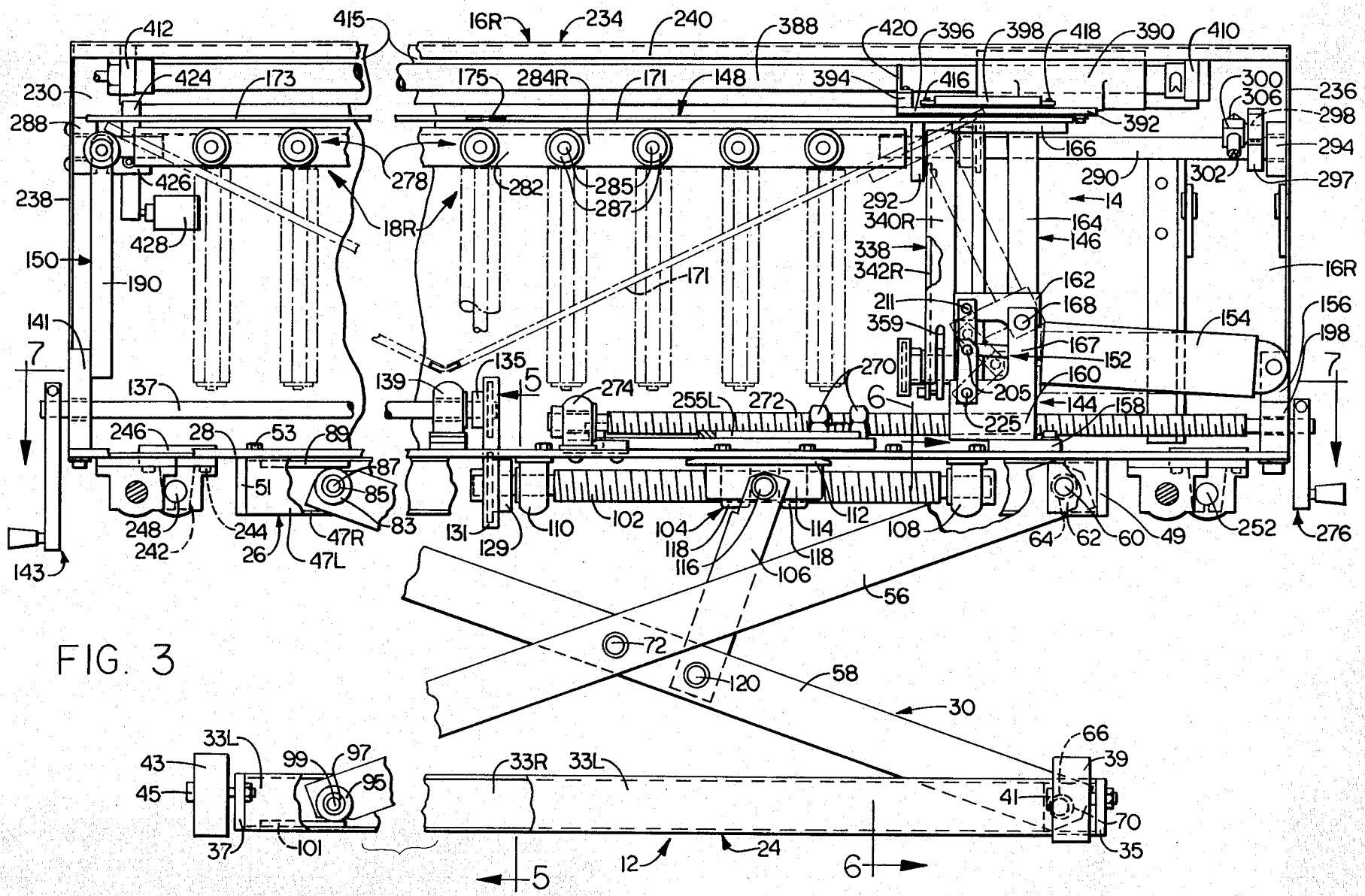
FIG. 3 is a view in side elevation of the machine on an enlarged scale, a hinged table of the machine being shown in lowered position in dot-dash lines.
Figure 4:
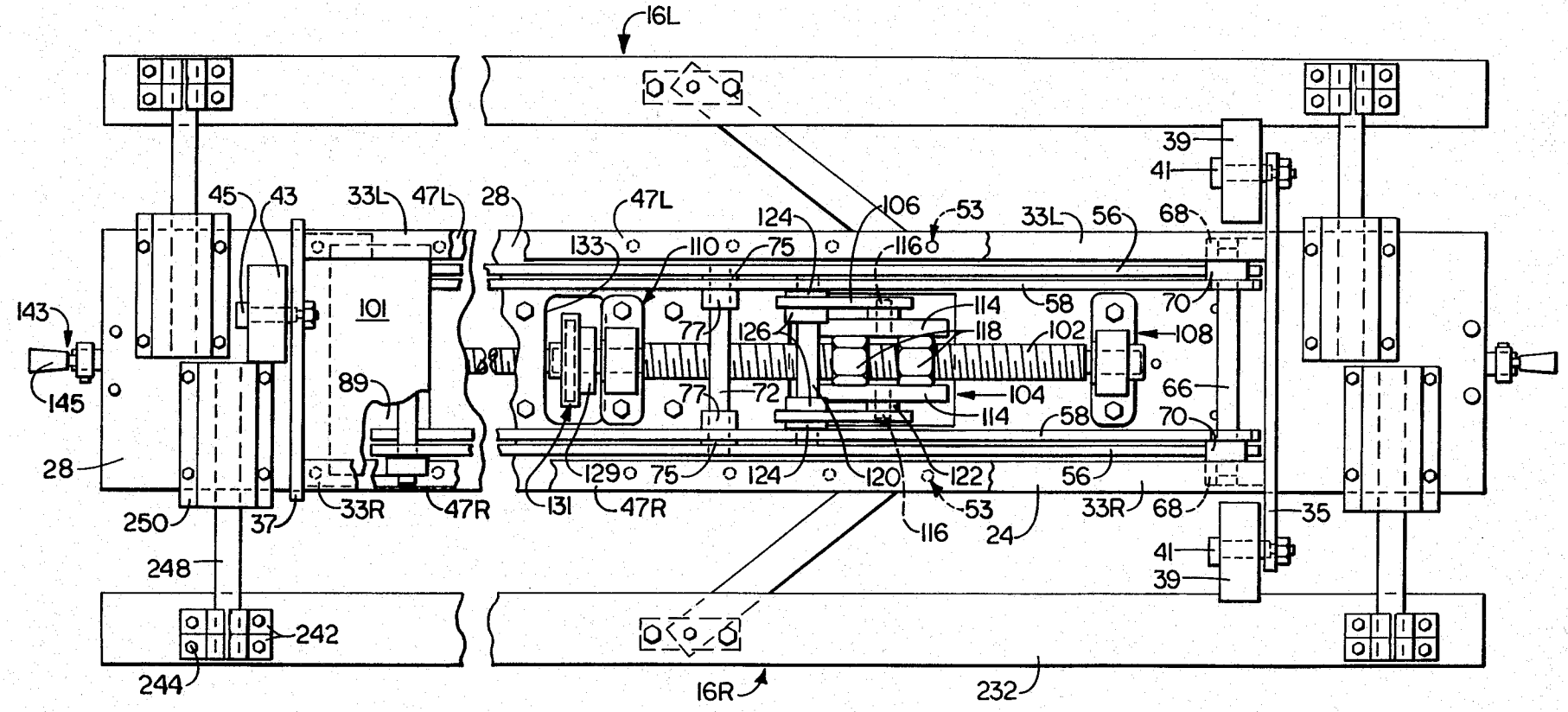
FIG. 4 is a bottom plan view of a base assembly of the machine.

The pairs of outer and inner diagonal bars 56 and 58, respectively, are pivotally mounted upon a center shaft 72 (FIGS. 3 and 4). Thrust washers 75 maintain lateral spacing between the pairs of diagonal bars while a pair of shaft collars 77 maintain the lateral placement of the diagonal bars upon the center shaft 72.

Figure 5:
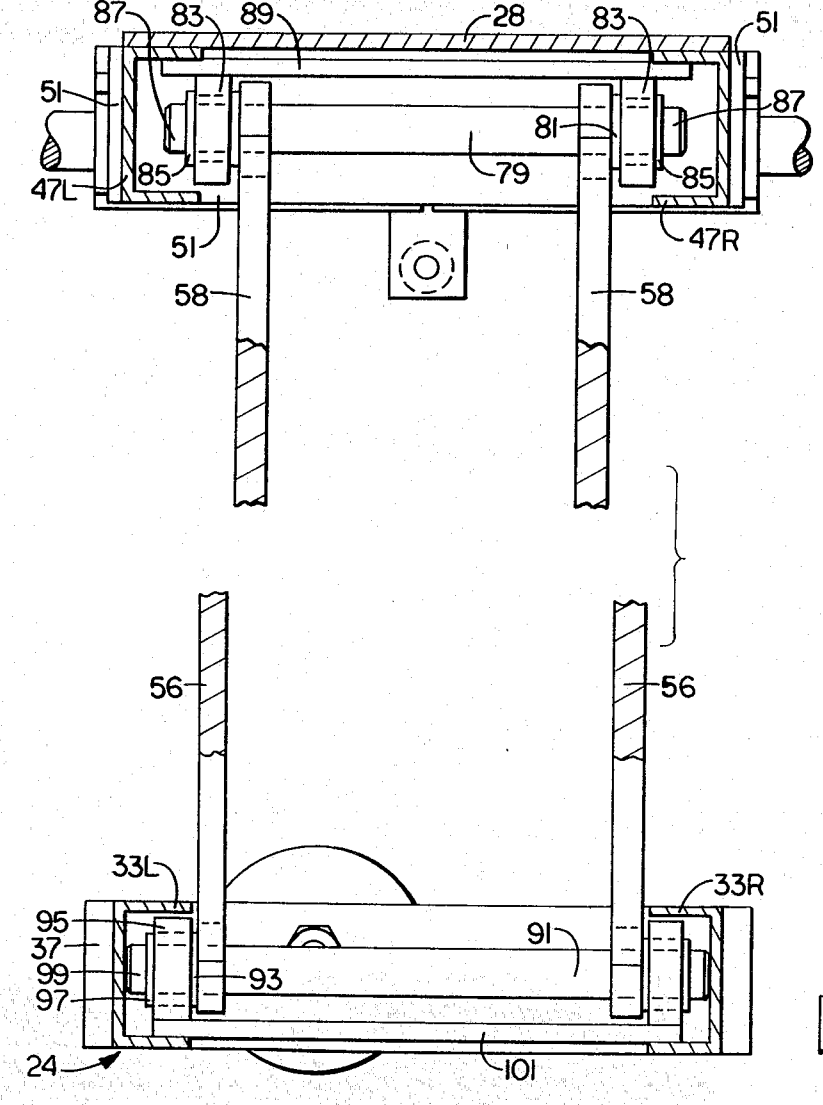
FIG. 5 is a view in section taken on the line 5—5 in FIG. 3.

An upper output shaft 79 is rotatably mounted through the upper output ends of the inner diagonal bars 58 as is clearly shown in FIG. 5. The ends of the upper output shaft 79 extend outwardly from the pair of inner diagonal bars 58 to receive thrust bearings 81, upper rollers 83, washers 85, and retainer bolts 87. The retainer bolts 87 are threadably mounted into the ends of the upper output shaft 79. The retainer bolts 87, washers 85, upper rollers 83, and thrust bearings 81, in conjunction with the pair of shaft collars 77 of the center shaft 72 and the cylindrical spacers 70 of the lower input bar 66, maintain the longitudinally disposed pair of inner diagonal bars 68 in latera11y spaced and parallel relationship. The upper rollers 83 work against a top roller plate 89 that is rigidly affixed across the lower surfaces of the upper flanges of, and at the output end of, the right and left channel members 47R and 47L, respectively. A lower output shaft 91 is rotatably mounted through the lower output ends of the outer diagonal bars 56, as is the upper output shaft 79, the only difference being that the lower output shaft 91 is somewhat longer than the upper output shaft 79. The lower output shaft 91 extends outwardly from the pair of outer diagonal bars 56 to receive thrust bearings 93, lower rollers 95, washers 97, and retainer bolts 99. The retainer bolts 99 are threadably mounted into the ends of the lower output shaft 91. The retainer bolts 99, washers 97, lower rollers 95, and thrust bearings 93, in conjunction with the thrust washers 75 of the center shaft 72, and the thrust bearings 64 of the upper input bar 60, maintain the pair of outer diagonal bars 56 in laterally spaced and parallel relationship. The lower rollers 95 work against the top surface of a bottom roller plate 101 that is rigidly affixed across the upper surfaces of the bottom flanges of the right and left channel members 33R and 33L, respectively.

The scissors assembly is opened, closed, and maintained in set position by a screw 102, a runner 104, and a pair of link bars 106. The screw 102 is rotatably mounted in an input bearing 108 and an output bearing 110 that are in turn fixedly attached along the centerline of and to the bottom surface of the base plate 28. The runner 104 is comprised of a torque plate 112, a pair of trunion mounts 114, trunion pins 116, and a pair of nuts 118. The pair of nuts 118 is rigidly affixed to the under surface of the torque plate 112. They are spacedly mounted to cooperate with the free operation of the screw 102. The trunion mounts 114 are rigidly affixed in vertical and longitudinal orientation alongside the nuts 118 to provide structure for cantilever mounting of the trunion pins 116 that extend outboardly therefrom. The trunion pins 116 receive thrust bearings 122 and pivotally receive the upper ends of the pair of links 106. The lower ends of the links 106 are pivotally mounted upon a link bar 120 that is in turn pivotally mounted in the inner diagonal bars 58 just upstream of the center shaft 72. Lateral placement of the links 106 is maintained by thrust washers 124 and shaft collars 126, the shaft collars 126 being fixedly attached to the link bar 120.

The output end of the screw 102 extends through the output bearing 110 to fixedly receive a sprocket 129. A transfer chain 131 circumscribes the lower arc of the sprocket 129, passes upwardly through a clearance hole 133 in the base plate 28, to circumscribe the upper arc of a transfer sprocket 135. The transfer sprocket 135 is fixedly attached to the input end of a transfer shaft 137 that is in turn rotatably mounted in a transfer bearing 139 and an end block 141. The transfer bearing 139 is fixedly attached upon the top surface of the base plate 28 adjacent the output edge of the clearance hole 133. The end block 141 is also fixedly attached to the top surface of the base plate 28 adjacent the output edge thereof. The transfer shaft 137 extends in the output direction through the end block 141 to fixedly accommodate a hand crank assembly 143. As an operator turns the hand crank assembly 143, the transfer shaft 137, the transfer chain 131, and the screw 102 turn, motivating the runner 104. As the runner 104 moves in the input direction, the pair of links 106 rotate clockwise as shown in FIG. 3 with respect to the link bar 120, thus lowering the base frame 26 with respect to the floor frame 24. Conversely, as the runner 104 is moved in the output direction, the base frame 26 will be raised with respect to the floor frame 24.

The unique placement of the wheels 39, the output wheel 43, and other elements specific to the scissors assembly 30 permit the base frame 28 to descend completely atop the floor frame 24 without interfering with itself or other equipment mounted on the base plate 28.

The table assembly 14 is comprised of a mount assembly 144, an input anchor support 146, a hinged table 148, an output support 150, a linkage assembly 152, a cylinder 154, and a cylinder mount 156 as is shown in FIGS. 3 and 7–11. The mount assembly 144 is further comprised of a base 158 and a pair of vertical members 160.

Figure 7:
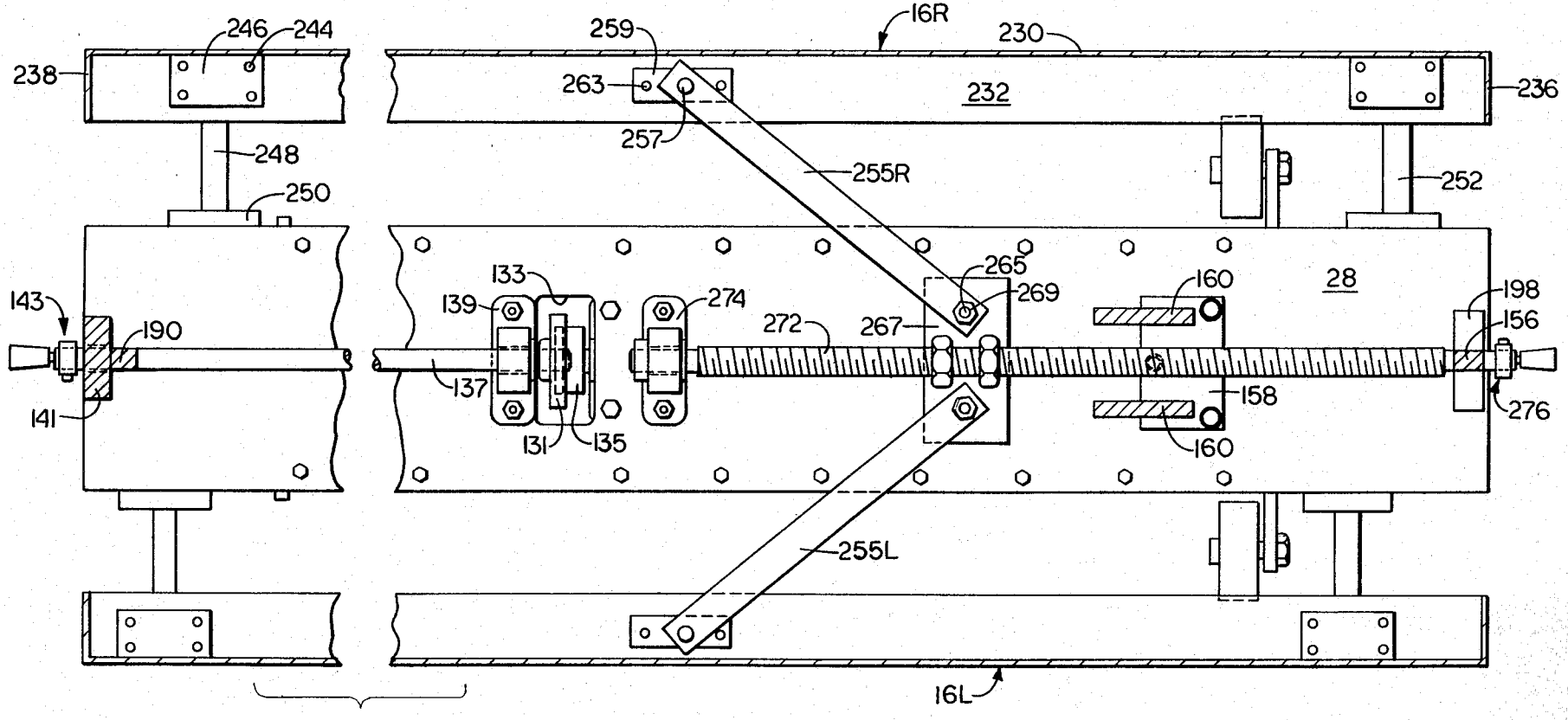
FIG. 7 is a view in section taken on the line 7—7 in FIG. 3.

The base 158 is fixedly attached to the top surface of, and approximate the input end of, the base plate 28 as is shown in FIG. 7. The vertical members 160 are of irregular shape as is shown in FIG. 3, with each of the vertical members 160 including an upright extension 167 at the input edge thereof. The vertical members 160 are rigidly affixed in upright position to the top surface of the base 158 such that the bottom portions of the vertical members 160 overhang the output edge of the base 158. The vertical members 160 are laterally spaced to accept the lower extremity of the input anchor support 146.

The input support 146 is comprised of two pivot arms 162, a riser bar and crank 164, and two table nut plates 166. The pivot arms 162 are rigidly affixed to the lower outboard sides of the riser bar 164 and extend in the output direction therefrom. The lower extremity of the input anchor support 146 is pivotally mounted upon a pin 168 that is in turn fixedly mounted across the uppermost portions of the upright extensions 167 of the vertical members 160. The table nut plates 166 are also rigidly affixed to the outboard sides of the riser bar 164, but at the upper end thereof. They are disposed in a horizontal plane so as to fixedly accept the input end of the hinged table 148.

Figure 8:
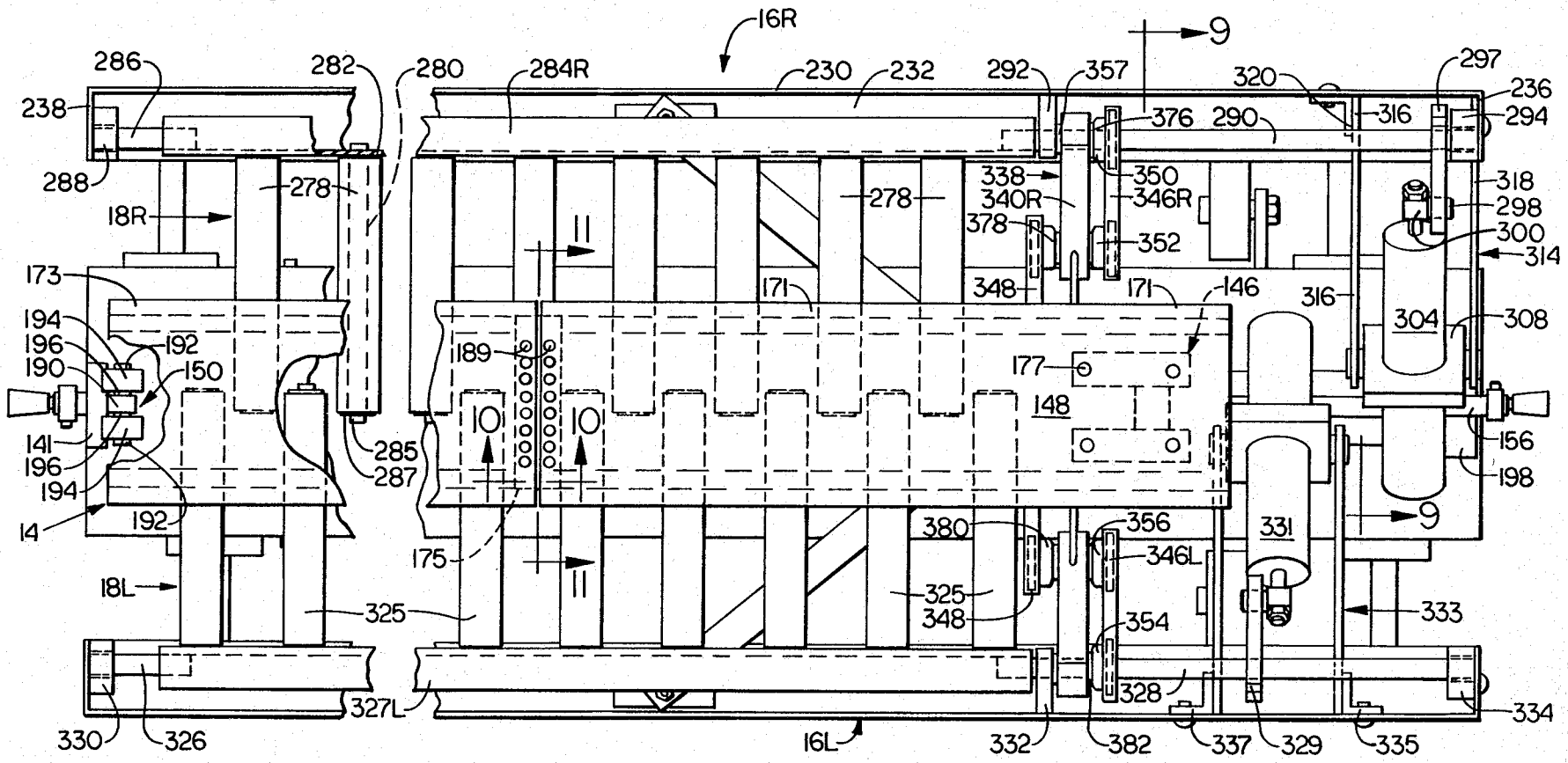
FIG. 8 is a plan view of the machine on an enlarged scale.
Figure 9:
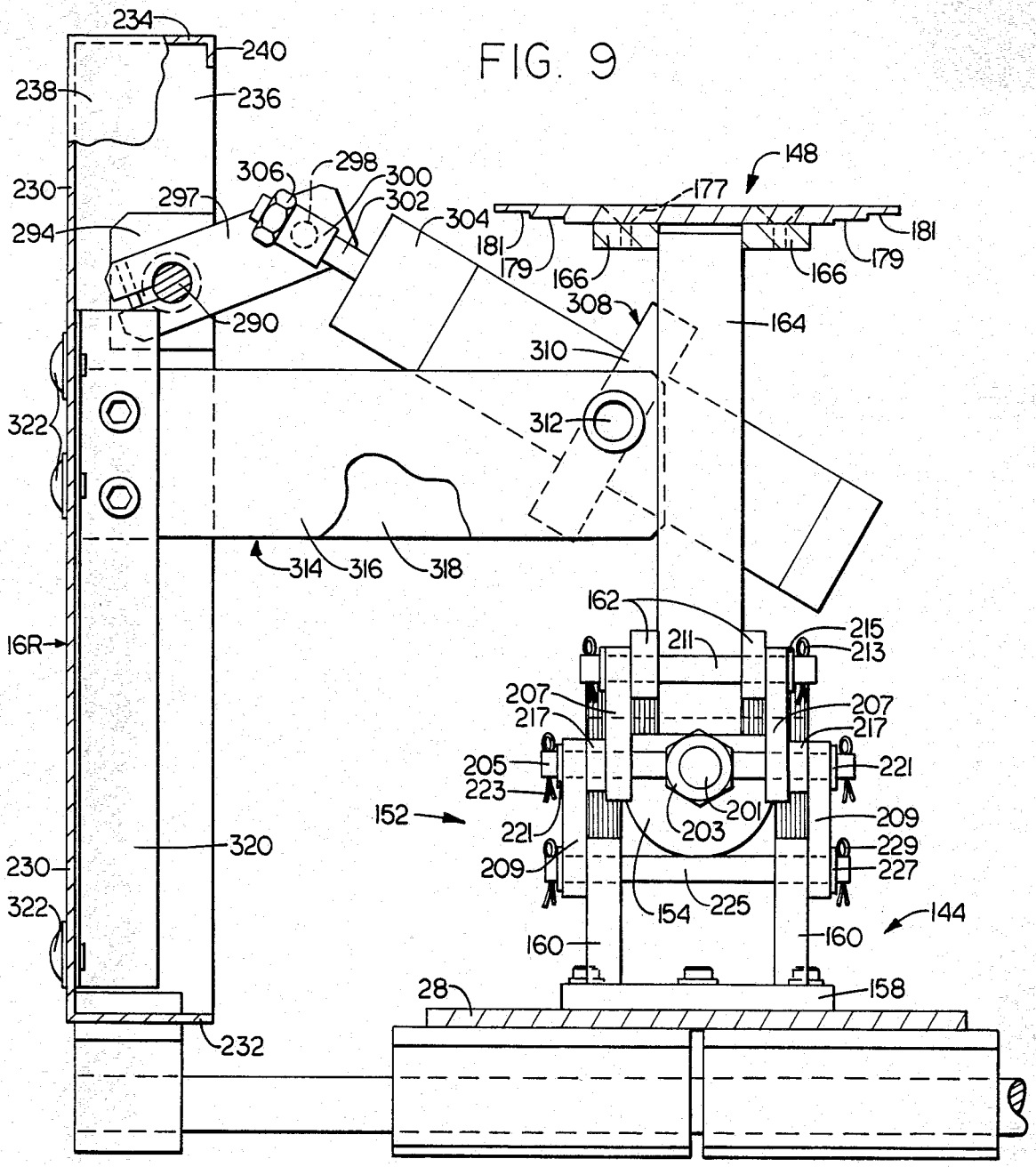
FIG. 9 is a view in section taken on the line 9—9 in FIG. 8.

The hinged table 148 incorporates an input segment 171, an output segment 173, and a hinge 175 as is best shown in FIGS. 8–11. Upper surfaces of the input and output segments 171 and 173 are provided with a coating of plastic material (not shown) to perform as a dry lubricant. The input end of the input segment 171 of the hinged table 148 is fixedly attached to the top surfaces of the table nut plates 166 by means of a set of four countersunk bolts 177, such that the input segment 171 is cantilever mounted in the output direction. Both of the segments 171 and 173 of the hinged table 148 are of the same width as is shown in FIG. 8 and are of similar cross-section and exhibit a first and second stop 179 and 181, respectively, along both sides of the bottom surface of the hinged table 148 as shown in FIG. 9. The first and second steps 179 and 181, respectively, form an effective taper along the edge of the hinged table 148 around which the major flaps of a carton can bend as will be described in detail hereinafter.

Figure 10:
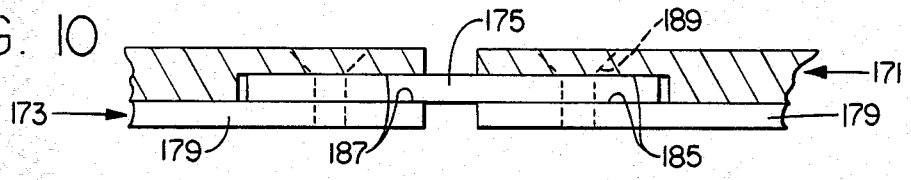
FIG. 10 is a view in section taken on the line 10—10 in FIG. 8.
Figure 11:
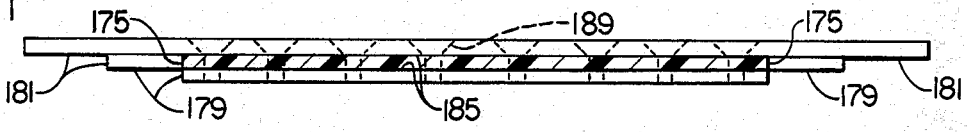
FIG. 11 is a view in section taken on the line 11—11 in FIG. 8.

The input segment 171 and the output segment 173 are joined by the hinge 175. The hinge 175 is constructed of a flexible material and is fixedly attached in a slot 185 of the input segment 171 and a slot 187 of the output segment 173 as is shown in FIGS. 10 and 11. Sets of flat head machine screws 189 pass through clear countersunk holes in the upper lip of the slots 185 and 187, through clear holes in the hinge 175, and fixedly mount in tapped holes in the lower lip of the slots 185 and 187. It should be noted that the first step 179 exposes the lower portion of FIG. 10 to full view, while the second step 181 is further outboard and is shown in section according to FIG. 9.

The discharge end of the output segment 173 of the hinged table 148 is supported by the output support 150 as is shown in FIGS. 3 and 8. The output support 150 incorporates in vertical disposition a post 190 that is rigidly affixed at its lower output surface to the upper input face of the end block 141. Shoulder bolts 192 receive rollers 194 and thrust washers 196, and threadably and opposedly mount into the right and left upper sides of the post 190.

The hinged table 148 is a two-position device; that is, it is either in the down position in the form of a "V" as is indicated in FIG. 3 in dot-dash lines, or raised to a position shown in full lines in FIG. 3 where the input and output segments 171 and 173, respectively, lie in the same horizontal plane. It is motivated and held in these fixed positions by the cylinder 154 and the linkage assembly 152. The base of the cylinder 154 is pivotally mounted at an upper end portion of the cylinder mount 156 that is in turn rigidly affixed to the top surface of, and at the center of, a bearing block 198. The bearing block 198 is rigidly affixed to the top central surface of the base plate 28.

The free end of a cylinder rod 201 of the cylinder 154 incorporates a nut 203 (FIG. 9) that in turn incorporates trunion rods 205. The two trunion rods 205 are rigidly affixed in clear holes in either side of the nut 201 and extend outwardly therefrom in a horizontal plane. Firstly, the trunion rods 205 pivotally receive upper toggle arms 207 whose upper ends in turn pivotally support a top toggle pin 211. The top toggle pin 211 is pivotally mounted through the output ends of the pivot arms 162. The upper toggle arms 207 are retained upon the top toggle pin 211 by cotter pins 213 and washers 215. Secondly, the trunion rods 205 receive spacers 217 and, thirdly, pivotally receive the upper ends of lower toggle arms 209. These elements are retained cn the trunion rods 205 with washers 221 and cotter pins 223. Bottom end portions of the two lower toggle arms 209 are pivotally mounted upon a bottom toggle pin 225 that is in turn pivotally mounted through the upper output corners of the vertical members 160 of the mount assembly 144. Again the lower toggle arms 209 are retained upon the bottom toggle pin 225 by washers 227 and cotter pins 229.

The sides 16R and 16L of the case erector 10 are shown in FIGS. 3, 4, 7 and 9, and function as side holding and guiding means for a corrugated case in the case erector 10. The right side 16R is a unitary rectangular framelike structure that comprises a side panel 230, a bottom flange 232, a top flange 234, an input flange 236, and an output flange 238. Also, an additional edge flange 240 is incorporated along the free edge of the top flange 234. Rigidity is added to the frame structure by rigidly affixing the ends of the edge flanges to each other at the corners. Other than rigidity, the edge flanges 240 of the sides 16R and 16L present a rolled edge to the sides of a corrugated case along which the case can slide during ejection.

Referring now to FIGS. 4 and 7, a pair of rod mounts 242 is fixedly attached to the underside of the bottom flange 232 approximate the output end thereof. A set of four bolts 244 passes upwardly through clear holes in the mounting feet of the pair of rod mounts 242, through clear holes in the bottom flange 232, and threadably mount in a nut plate 246. A rod 248 is fixedly attached at its outboard end in the pair of rod mounts 242 and extends inboardly passing through a linear bearing 250. The linear bearing 250 is fixedly attached to the underside of and adjacent the right side of the base plate 28.

A rod 252 is mounted and supports the input end of the side 16R in the same way as the rod 248 supports the output end of the side 16R. The rods 248 and 252, by virtue of their linear bearings, provide a degree of lateral movement to the side 16R. The side 16L is mounted in the same way as the right side 16R, save for the longitudinal positioning of the rod and bearing assemblies, which are located slightly downstream so that the shafts of the respective sides can pass each other when the right and left sides 16R and 16L are narrowly spaced.

Figure 12:
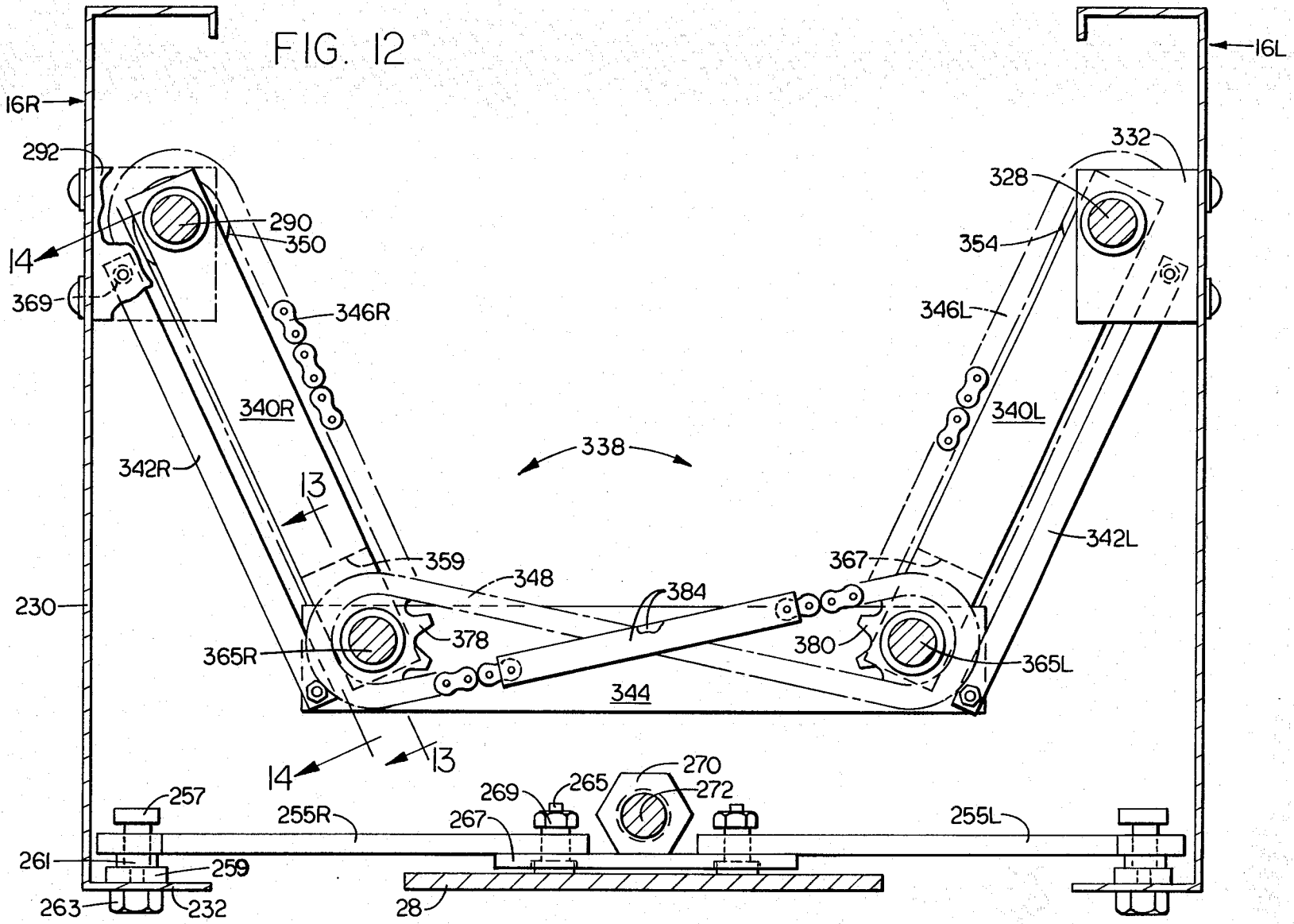
FIG. 12 is a view in transverse section of the machine.

The right and left sides 16R and 16L, respectively, are motivated and held in lateral placement by horizontal bars 255R and 255L, as is shown in FIGS. 3, 7 and 12. The outboard end of the bar 255R is pivotally mounted upon a shoulder bolt 257 that is in turn threadably mounted into the top of an attachment block 259. A bearing spacer 261 resides on the shoulder of the bolt 257 between the attachment block 259 and the end of the horizontal bar 255R. The attachment block 259 is fixedly attached to the inside surface of, and at the longitudinal center of, the bottom flange 232. Two bolts 263 pass through clear holes in the bottom flange 232 and threadably mount in the attachment block 259.

The inboard end of the horizontal bar 255R is pivotally mounted upon a shoulder screw 265. The shoulder screw 265 passes upwardly through, and is rigidly affixed in, a clear counterbored hole in the right side of a slide plate 267, such that the head of the shoulder screw 265 protrudes slightly from the bottom of the slide plate 267. The horizontal bar 255R is retained on the shoulder screw 265 by a nut 269. The horizontal bar 255L is mounted with respect to the left side 16L in the identical but mirror image manner as the right side 16R as just described. The heads of the shoulder screws 265 bear and slide upon the top surface of the base plate 28.

A pair of nuts 270 is rigidly affixed in edgewise disposition to the top surface of, and at the center of, the slide plate 267. The nuts 270 are longitudinally spaced to cooperate with the threads of a threaded rod 272. The threaded rod 272, being longitudinally disposed along the centerline of the machine, passes between the vertical members 160 of the mount assembly 144 of the table assembly 14. A clear output extension of the threaded rod 272 is fixedly but rotatably attached within a bearing block 274 that is in turn fixedly attached to the top surface of the base plate 28 near the input edge of the clearance hole 133. The input end of the threaded rod 272, also a clear extension thereof, is rotatably mounted through the bearing block 198. The input extremity of the threaded rod fixedly incorporates a crank assembly 276. As an operator turns the crank assembly 276 in one direction, the slide plate 267 is moved toward the input end of the case erector 10, thus narrowing the spacing between the sides 16R and 16L. Conversely, as the operator turns the crank assembly 276 in an opposite direction, the sides of the case erector 10 will open to receive larger cases.

The roller assemblies 18R and 18L are shown in FIGS. 2, 3 8 and 9. The right hand roller assembly 18R incorporates ten rollers 278 that are rotatably mounted upon cantilever shafts 280. Each shaft 280 is rigidly affixed at its outboard end through a clear hole in a flange 282 of a right-angle member 284R. Each roller 278 is retained upon its cantilever shaft by a bolt 285 that is threadably mounted into the free end thereof. The head of the bolt 285 is rigidly affixed in the inside diameter of a washer 287, such that a face of the washer 287 and the seating surface of the head of the bolt 285 lie in the same plane. The washer has sufficient diameter to retain the associated roller 278.

The output end of the right-angle member 284R rigidly incorporates a cylindrical shaft extension 286 that is in turn pivotally mounted in an end bearing block 288. The end bearing block 288 is fixedly attached to the inside surface of the output flange 238 of the right side 16R. The input end of the right-angle member 284R also rigidly incorporates a torque shaft 290. The torque shaft 290 is pivotally mounted through a mid bearing block 292 that is longitudinally located adjacent the input support 146 of the table assembly 14, and in an input bearing block 294 at the front of the case erector 10. The mid bearing block 292 is fixedly attached to the inside surface of the side panel 230, and the input bearing block 294 is fixedly attached to the inside surface of the input flange 236. The three bearing blocks 288, 292 and 294 are attached to the side 16R by round or pan head bolts that pass through clear holes in the sheet metal to threadably mount into their respective pieces. Round or pan head bolts improve the appearance of the exterior of the machine and, more importantly, eliminate the possibility of injury on ordinary bolt heads.

A torque arm 297 is clampedly attached to the torque shaft 290 adjacent the output surface of the input bearing block 294 and extends inboardly. The inboard end of the torque arm 297 pivotally receives a pin 298 that is longitudinally disposed with respect to the case erector 10. The pin 298 is an integral part of, and extends from the input surface of, a rod end block 300. The rod end block 300 incorporates a threaded bore that is perpendicular to the pin 298. The rod end block 300 is threadably mounted on the working end of a cylinder rod 302 of a cylinder 304, and is fixedly held in place by a jam nut 306. The cylinder 304 is fixedly mounted in a trunion block 308. The trunion block rigidly incorporates pins 312 protruding from the input and output faces thereof. The pins 312 are pivotally mounted across the inboard ends of a clevis mount 314. The clevis mount 314 is transversely and horizontally disposed and incorporates an output member 316 and an input member 318. The output member 316 is fixedly attached to the input surface of an angle support 320 that is in turn fixedly attached to the inboard surface of the side panel 230 of the side 16R. The angle support 320 is longitudinally located adjacent to the input support 146 of the table assembly 14. The angle support 320 is fixedly attached to the side 16R by screws 322 that pass through clear holes in the sheet metal to threadably mount in its longitudinally disposed flange. The screws 322 incorporate heads of the round or pan type, since the external appearance and safety of the machine is enhanced.

The left side roller assembly 18L utilizes eleven rollers 325 that are rotatably mounted in cantilever form along a right angle member 327L in the same manner as the rollers 278 of the right side roller assembly 18R. The longitudinal placement of the eleven rollers 325 along the right angle member 327L is such so as to provide a staggered relationship with the ten rollers 278 of the right side roller assembly 18R. The right angle member 327L rigidly incorporates an output shaft extension 326, and a torque shaft 328 extending from the input end thereof. The torque shaft 328 is pivotally mounted to the left side 16L in the same manner as, but in mirror image to, the right angle member 284R by means of an output bearing 330, a mid bearing 332, and an input bearing 334.

A torque arm 329, a left side cylinder 331, and a clevis mount 333 is in identical assembly as that of the torque arm 297, cylinder 304, and clevis mount 314. The left side cylinder 331 and its associated parts as just described are mounted to the inside surface of the left side 16L between the input support 146 of the table assembly 14 and the cylinder 304. An input angle 335 and an output angle 337 are vertically disposed and fixedly attached to the left side 16L in the same way as the angle support 320 of the right side 15R. They are fixed in spaced and parallel relationship to accept the outboard ends of the clevis mount 333 that is fixedly attached therebetween.

The cylinder 304 and the left side cylinder 331 work in unison to hold the right and left hand roller assemblies 18R and 18L, respectively, in horizontal planes when their cylinder rods are extended. When the cylinder rods are retracted, the roller assemblies 18R and 18L rotate downwardly to a vertical disposition providing clearance for the table assembly 14 to operate.

The cylinders 304 and 331 are required to work in unison by a chain assembly 338 that is shown in FIGS. 3, 8, 12, 13 and 14. The chain assembly 338 is comprised of a right side radius arm 340R and a left side radius arm 340L, a right side control arm 342R and a left side control arm 342L, a connector plate 344, a right side radius chain 346R and a left side radius chain 346L, a crossover chain 348, an upper right hand sprocket 350, a lower right hand sprocket 352, an upper left hand sprocket 354, and a lower left hand sprocket 356. The upper end of the radius arm 340R is pivotally mounted upon the torque shaft 290, and spacedly set away from the input surface of the mid bearing block 292 by a thrust washer 357. The lower end of the radius arm 340R incorporates a transverse slot 359 and a longitudinal bore 361 through the tines thereof as is most clearly shown in FIG. 13. Each end of the longitudinal bore 361 compressively receives a flange bearing 363 that in turn pivotally receive a shaft 365R.

The left side radius arm 340L is constructed in the same manner as the right side radius arm 340R, incorporating a left side transfer shaft 365L and a slot 367 in the lower portion thereof. The left side radius arm 340L is also mounted upon the torque shaft 328 in the same way as the right side radius arm 340R is mounted upon the torque shaft 290.

The connector plate 344 incorporates a bearinged bore 371 (FIG. 13) at each end thereof, being pivotally mounted upon the right and left transfer shafts 365R and 365L, respectively. The upper end of the right hand control arm 342R is pivotally mounted against the input face of the mid bearing block 292 by a shoulder bolt 369 (FIG. 14). A lower end portion of the right hand control arm 342R is pivotally mounted to the lower right hand output face of the connector plate 344 by a shoulder bolt 373. A spacer 375 is placed between the connector plate 344 and the right hand control arm 342R for longitudinal alignment purposes. The left hand control arm 342L is mounted in a similar way to the mid bearing 332 and a left hand end portion of the connector plate 344.

The radius arm 340R and the control arm 342R (FIG.12), being pivotally connected to the mid bearing block 292 and the right end of the connector plate 344, forms a parallelogram structure. The radius arm 340L and the control arm 342L is likewise pivotally connected to the mid bearing 332 and the left end of the connector plate 344 again forming a parallelogram structure. Thus, the pair of parallelogram structures pivotally support the connector plate 344 requiring it to always remain horizontally disposed.

FIG. 8 most clearly shows that the upper right hand sprocket 350 is fixedly attached to the torque shaft 290 near the input side of the mid bearing block 292 and is spaced from the radius arm 340R by a thrust washer 376. The right hand radius chain 346R circumscribes the upper arc of the upper right hand sprocket 350 and communicates downwardly with the lower right hand sprocket 352. The lower right hand sprocket 352 is fixedly attached to the input end of the right hand transfer shaft 365R. The output end of the same shaft fixedly incorporates a right side transfer sprocket 378. The crossover chain 348 circumscribes the outboard arc of the right hand transfer sprocket 378 to communicate laterally to the left with a transfer sprocket 380 that is in turn fixedly attached to the output end of the transfer shaft 365L. As is shown in FIG. 12, the crossover chain does cross over itself, producing a possible interference. This interference is averted by connector straps 384 that are fixedly attached to the ends of the crossover chain 348 on the input and output sides thereof. The input end of the transfer shaft 365L fixedly accommodates the lower left hand sprocket 356. The left hand radius chain 346L essentially circumscribes the lower arc of the lower left hand sprocket 356 to communicate upwardly with the upper left hand sprocket 354 that is in turn fixedly attached to the torque shaft 328. A thrust washer 382 intervenes between the upper left hand sprocket 354 and the input face of the mid bearing 332. Therefore, any rotation of the torque shaft 290 of the right hand roller assembly 18R will cause an equal counter-rotation of the torque shaft 328 of the left hand roller assembly 18L. Enough space is provided between the ends of the crossover chain 348 by the connector strap 384 to permit the necessary pivoting. In this manner, the cylinders 304 and 331 and the right and left hand roller assemblies 18R and 18L are required to operate in unison.

The case ejector 20 is shown in FIGS. 2, 3, 15 and 16. It is comprised of a rodless cylinder 388, a cylinder module 390, an arm plate 392, an arm 394 and arm stop 396, and a return spring 398. The rodless cylinder 388 is essentially a clear tube that is provided with air inlet heads at both ends. A piston head without rods is fitted within the clear tube and is driven in either direction by the introduction of air at the appropriate end while the opposite end of the tube is vented to atmosphere. The piston head is constructed of magnetic material. The cylinder module 390 is bearing mounted on the outside of the clear tube of the rodless cylinder 388 and is also contructed of magnetic material. It will therefore follow the internal piston head. The rodless cylinder 388 is fixedly mounted along the upper inside surface of the side panel 230 of the side 16R by an input cylinder-mounting block 410 and an output cylinder-mounting block 412. Round head bolts 414 pass through clear holes in the sheet metal of the side 16R to threadably mount in the input and output cylinder-mounting blocks 410 and 412, respectively, as is indicated in FIG. 16. A strip of plastic tape 415 is applied to the upper inside surface of the side panel 230 between the input and output cylinder-mounting blocks 410 and 412, respectively, to provide a low friction surface against which the cylinder module 390 can slide. This feature retains the cylinder module 390 and the arm 394 in horizontal position.

The arm 394 of the case ejector 20 is a square member in section that is pivotally attached at its right end to the top surface of, and at the left hand output corner of, the arm plate 392. The arm plate 392 is fixedly attached to the bottom surface of the cylinder module 390 in such disposition that it extends to the left and output directions therefrom. The arm stop 396 is rectangular in plan form and is rigidly affixed to the bottom of the arm 394 abutting the left edge of the arm plate 392. The arm stop 396 extends in the input direction to provide mounting for a spring post 416. The spring post 416 is fixedly pressed into the top surface of the arm stop 396. The spring 398 extends from the spring post 416 to a second spring post 418 that is in turn fixedly pressed into the top left hand surface of the arm plate 392 adjacent to the cylinder module 390. In this manner, the arm 394 is rigidly held in transverse orientation across the table assembly 14 to move filled cases in the output direction off the table assembly 14 onto the output conveyor 22 as is indicated in FIG. 1. As the case ejector 20 returns to its "home" position at the input end of the case erector 10, the arm 394 of the case ejector 20 is free to pivot clockwise with respect to FIG. 2 if an obstruction is on the table assembly 14. An obstruction is likely to be the operator's hands and arms, or another case inserted into the machine at an inappropriate time. The spring 398 will bring the arm 394 back to transverse position after the obstruction has been passed. The arm 394 is fixedly provided with an angle member 420 having an upright flange 421. The angle member 420 is mounted upon the top surface of the arm 394 to provide a large area of contact with a corrugated case being processed through the machine.

The arm plate 392 of the case ejector 20 incorporates a rectangular cutout 422 (FIG. 16) in the right hand output end thereof. This rectangular cutout 422 cooperates against a lever 424 that is in turn pivotally mounted upon a pivot block 426. The pivot post block 426 is fixedly attached to the inside surface of the side panel 230 of the side 16R just upstream of the end bearing block 288 of the right hand roller assembly 18R. The lower input edge of the lever 424 works against the plunger of a valve 428 that is in turn fixedly attached to the inside surface of the side panel 230. The valve 428 is actuated by rotation of the lever arm 424 to indicate that the case ejector 20 has reached the output end of its travel. The rodless cylinder 388 then returns to its "home" position at the input end of the machine.

Figure 17:
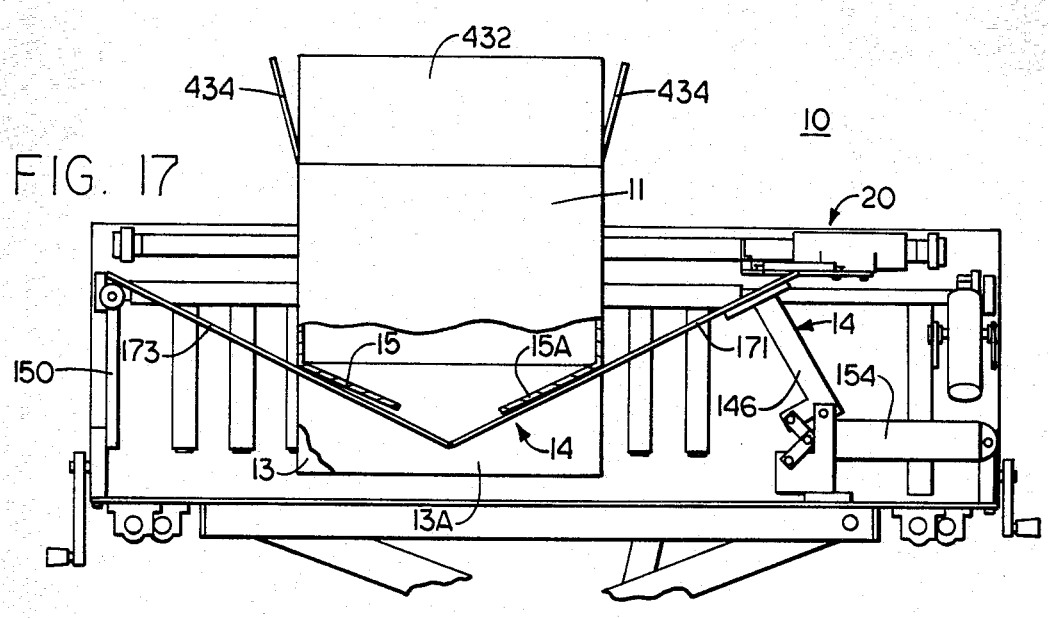
FIG. 17 is a schematic view showing a first position of the machine.
Figure 20:
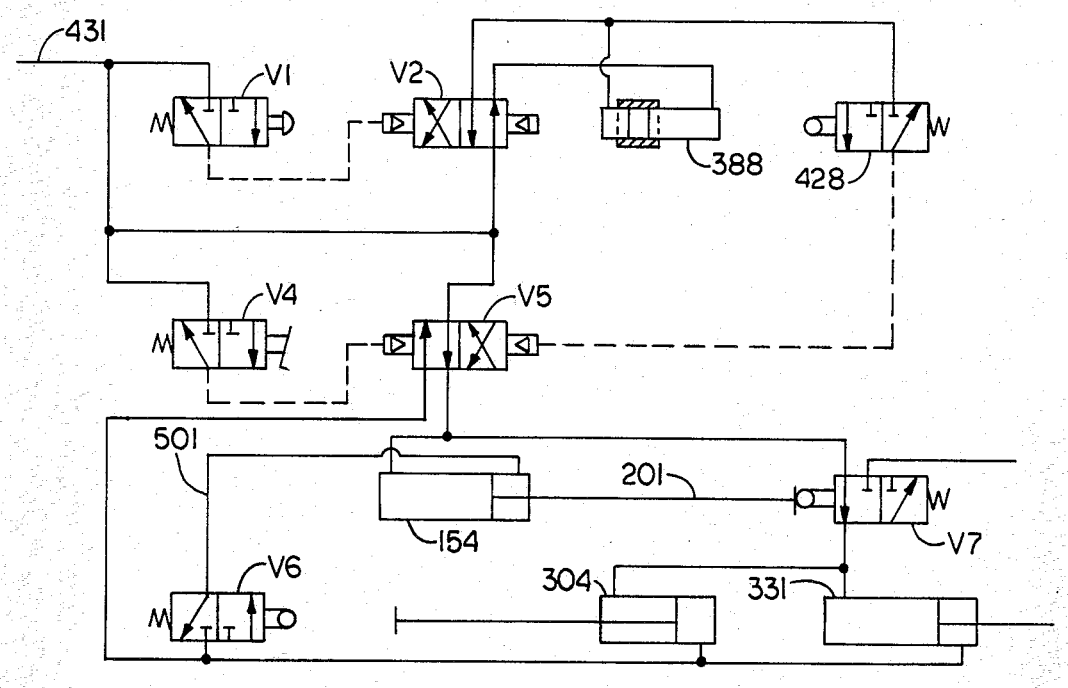
FIG. 20 is a schematic view of pneumatic connections of the machine.

The operation of the case erector 10 is shown in FIGS. 17, 18, 19 and 20. In FIG. 20, a source of air under pressure is indicated at 431. The start position of the semi-automatic case erector 10 is shown in FIG. 17. Note that the table assembly 14 is in the down position forming a "V" configuration and that the case ejector 20 is in its "home" position at the input end of the case erector 10, Also, the right and left hand roller assemblies 18R and 18L, respectively, are in their vertical position.

An operator, not shown, picks up a collapsed corrugated case and opens it to a square configuration when viewed from the top of the corrugated case or box. Opened case 11, with upper major flaps 432 and upper minor flaps 434 extending upwardly, and the lower major flaps 13 and 13A and the lower minor flaps 15 and 15A extending downwardly, is brought over and downwardly upon the table assembly 14 such that the lower extremities of the lower minor flaps 15 and 15A slide inwardly upon the upper surfaces of the segments 171 and 173 of the table assembly 14 to come to the partially closed position as shown in FIG. 17. The lateral position of the opened case 11 is controlled by the close transverse spacing of the sides 16R and 16L with respect to the right and left hand sides of the opened case 11. The lower major flaps 13 and 13A extend downwardly past the lateral edges of the table assembly 14.

Figure 18:
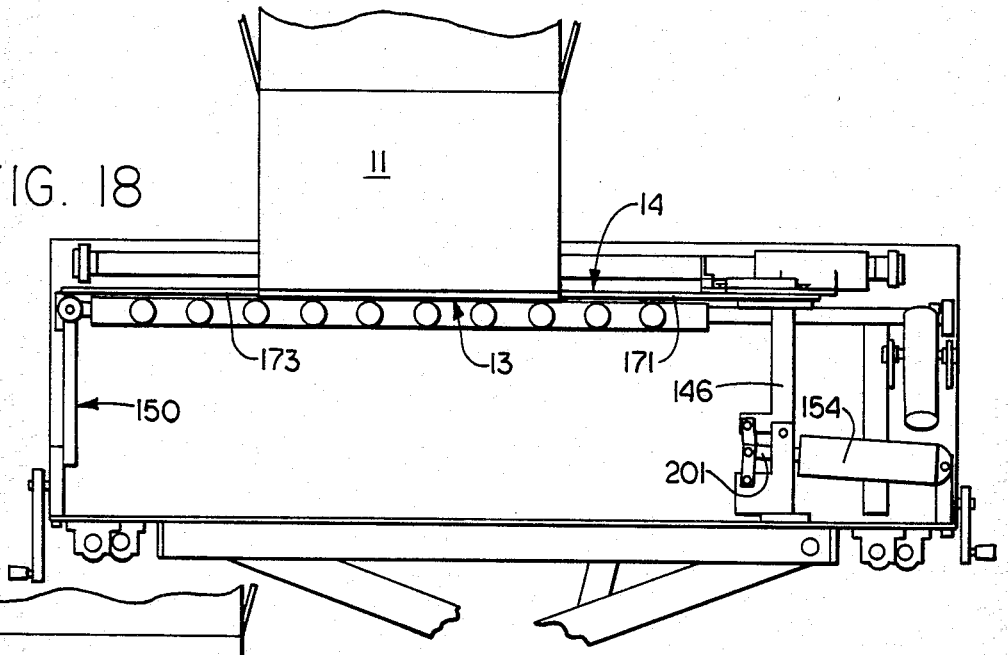
FIG. 18 is a schematic view showing a second position of the machine.
Figure 19:
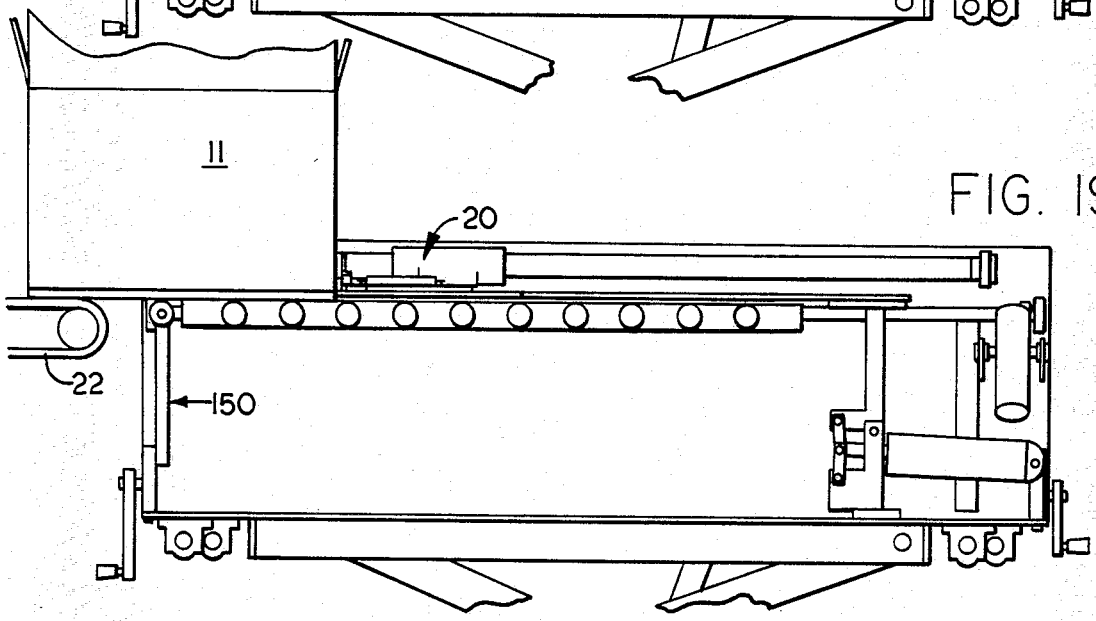
FIG. 19 is a schematic view showing a third position of the machine.

The operator depresses a foot switch V4 to make the circuit that actuates a valve V5. When the valve V5 is actuated to the position shown, the cylinder rod 201 of the cylinder 154 is advanced to cause raising of the segments 171 and 173 of the table assembly 14 to up position as shown in FIG. 18, and folding the lower minor flaps 15 and 15A to a horizontal plane. As the table assembly 14 is raised, the anchor support 146 to the right, as shown in FIGS. 17 and 18, drawing the input end of the input segment 171 to the right while the effective length of the table assembly 14 increases, and the output end of the output segment 173 remains above the output support 150. When the cylinder rod 201 is extended, a valve V7 is in the position shown in FIG. 20 to direct air under pressure to the cylinders 304 and 331 to cause the roller assemblies 18R and 18L to pivot from their vertical positions to horizontal positions, thereby folding the lower major flaps 13 and 13A inwardly under the table assembly 14. The horizontal position of the roller assemblies 18R and 18L is such as to support the open case 11 and the input and output segments 171 and 173 of the table assembly 24 above the output support 150 thereof. The open case 11 is now securely held in the case erector 10, permitting the operator to release the open case and perform other manual operations and to fill the case with a load such as a slug of cartons (not shown). After the open case 11 is filled, the operator actuates a valve Vl which actuates a valve V2 directing air under pressure to the rodless cylinder 388 to move the case ejector 20 in the output direction, thereby moving the open case 11 onto the output conveyor 22. When the case has been ejected, a valve 428 is advanced to its other position to cause the valve V2 to advance to the position shown to cause return actuation of the rodless cylinder 388, and the valve V5 is advanced to its other position to cause retraction of the cylinder rods of the cylinders 304 and 331 to cause lowering of the roller assemblies 18R and 181. When the rods of the cylinders 304 and 331 are retracted, a valve V6 is actuated to direct air under pressure along a line 501 to the cylinder 154 to cause retraction of the rod 201 thereof and lowering of the table segments 171 and 173.

The machine illustrated in the drawings and described above is subject to structural modification without departing from the spirit and scape of the appended claims.

Having described our invention, what we claim as new and desire to secure by letters patent is:

1. A device for erecting a folding carton having lower end flaps and lower side flaps and for holding the folding carton which comprises two parallel side members, a table intermediate the side members which includes an elongated input segment and an elongated output segment, means on the segments for hinging an output edge of the input segment to an input edge of the output segment, an anchor support member supporting an input end of the input segment, the input segment extending cantilever-fashion from the anchor support member, an output support underlying an output end portion of the output segment, the output end portion of the output segment being movable upwardly from the output support, means connected to the anchor support member for moving the anchor support member between a lowered position in which the segments of the table form a V-shape and a raised position in which the segments of the table are substantially horizontally aligned, the lower end flaps of the carton being engageable with the segments when in lowered position to partially fold the lower end flaps, the lower end flaps being further folded when the segments of the table are advanced from the lowered position to the raised position, side flap folding members hingedly mounted by hinge means or respective side members on opposite sides of the table, the hinge means for the side flap folding members being substantially horizontal and parallel to the table segments and at substantially a horizontal plane of the table segments when the table segments are in a raised position, means connected to the side flap folding members for swinging the side flap folding members between a lowered position free of the table segments and a raised position underlying and supporting the lower side flaps in closed position, and means connected to one of the side members for sliding the carton with folded lower flaps off the output end of the output segment to remove the carton from the table segments.

2. A device as in claim 1 in which each of the side flap folding members includes a framework hingedly mounted to a respective side member and a plurality of rollers journaled on the associated framework, axes of the rollers extending transversely of the associated framework, axes of the rollers being substantiallv horizontal when in raised position with the rollers underlying and supporting the lower side flaps.

3. A device as in claim 1 including a base, the anchor support member is mounted on a crank arm mounted on the base and the crank arm swings the anchor support member in table raising direction and draws the portion of the table mounted on the anchor support member away from the output support as the effective length of the table increases so that the output end portion of the output segment remains above the output support.

4. A device as in claim 1 in which the side members include side walls aligned with and on opposite sides of the table segments for guiding the carton as the lower flaps of the carton are folded and as the carton is slid off the output end of the output segment.

5. A device as in claim 2 in which axes of the rollers of the side flap folding members are offset and end portions of the rollers overlap when in raised position.

* * * * *

UNITED STATES PATENT AND TRADEMARK OFFICE

CERTIFICATE OF CORRECTION

PATENT NO. : 4,515,581

DATED : May 7, 1985

INVENTOR(S) : Edwin A. Molitor, Edward Crain and Guy W. Lampe

It is certified that error appears in the above-identified patent and that said Letters Patent are hereby corrected as shown below:

In Claim 1 at Col. 13, line 5, "or" should be - - on - -.

Signed and Sealed this

*Thirteenth* Day of *August 1985*

[SEAL]

*Attest:*

DONALD J. QUIGG

*Attesting Officer* *Acting Commissioner of Patents and Trademarks*